US009287661B2

(12) United States Patent
Lee

(10) Patent No.: US 9,287,661 B2
(45) Date of Patent: Mar. 15, 2016

(54) CLIP AND LATCH SUBSTITUTION DEVICE FOR MODULAR PLUGS

(71) Applicant: Bit64 Solutions Ltd., Markham (CA)

(72) Inventor: Leonard Chee Min Lee, Markham (CA)

(73) Assignee: Bit64 Solutions Ltd., Markham (CA)

( * ) Notice: Subject to any disclaimer, the term of this patent is extended or adjusted under 35 U.S.C. 154(b) by 0 days.

(21) Appl. No.: 14/287,428

(22) Filed: May 27, 2014

(65) Prior Publication Data

US 2014/0349506 A1 Nov. 27, 2014

Related U.S. Application Data

(60) Provisional application No. 61/827,710, filed on May 27, 2013.

(51) Int. Cl.

| | |
|---|---|
| ***H01R 13/627*** | (2006.01) |
| *H01R 24/62* | (2011.01) |
| *H01R 24/64* | (2011.01) |
| *H01R 43/26* | (2006.01) |

(52) U.S. Cl.

CPC ..... *H01R 13/6275* (2013.01); *H01R 13/6272* (2013.01); *H01R 24/62* (2013.01); *H01R 24/64* (2013.01); *H01R 43/26* (2013.01); *Y10T 29/49947* (2015.01)

(58) Field of Classification Search

CPC ..... H01R 24/64; H01R 13/6272; H01R 24/62
USPC ..... 439/345, 344
See application file for complete search history.

(56) References Cited

U.S. PATENT DOCUMENTS

| | | | | |
|---|---|---|---|---|
| 7,025,636 | B2 | 4/2006 | Allen | |
| 7,101,212 | B1 | 9/2006 | Larkin | |
| 7,223,109 | B1 | 5/2007 | Cors | |
| 7,361,047 | B2 | 4/2008 | Strahl | |
| 7,540,756 | B1 * | 6/2009 | Strahl | H01R 13/6272 439/344 |
| 7,578,692 | B2 | 8/2009 | Kaneda | |
| 7,686,638 | B2 * | 3/2010 | Boyd | H01R 13/6272 439/344 |
| 7,708,581 | B2 | 5/2010 | Weiss | |
| 7,862,384 | B2 | 1/2011 | Myers | |
| 2006/0046575 | A1 | 3/2006 | Allen | |
| 2007/0270016 | A1 | 11/2007 | Boyd et al. | |
| 2010/0304617 | A1 | 12/2010 | Ma et al. | |

FOREIGN PATENT DOCUMENTS

| | | | |
|---|---|---|---|
| WO | 2011113502 | A1 | 9/2011 |

* cited by examiner

*Primary Examiner* — Abdullah Riyami
*Assistant Examiner* — Justin Kratt
(74) *Attorney, Agent, or Firm* — Finch & Maloney PLLC

(57) ABSTRACT

A clip and latch device including: a mount including a securing base defining a plane, a rear end and a front end, a clip base mounted at the rear end of the securing base, a clip having a normally downward angle from the clip base towards the front end of the securing base, and a latch which terminates at the clip and normally extending so that the latch reaches to at least the plane of the securing base. The clip and latch device can be used for modular male plug, for example a male RJ plug, which may be with or without a broken tab or latch.

24 Claims, 10 Drawing Sheets

CLIP AND LATCH SUBSTITUTION DEVICE FOR MODULAR PLUGS

CROSS-REFERENCE TO RELATED APPLICATION(S)

This application claims the benefit of priority to U.S. patent application Ser. No. 61/827,710 entitled CLIP AND LATCH SUBSTITUTION FOR MODULAR PLUGS filed May 27, 2013, the contents of which are hereby incorporated by reference.

FIELD

Example embodiments described herein relate generally to device connectors, and more specifically to male Register Jack modular connectors.

BACKGROUND

A Registered Jack (RJ) is a standardized physical network interface, including both the jack construction and the wiring pattern, for connecting device, computer, telecommunications or data equipment. The standard designs for these connectors and their wiring include RJ11, RJ14, RJ21, RJ35, RJ45, RJ48, etc. Many of these interface standards are commonly used in North America, though some interfaces are used world-wide. RJ typically refers to either or both of the male (plug) component and the female (socket) component.

The physical connectors that registered jacks use are mainly of the modular connector and pin miniature ribbon connector types. For example, RJ11 uses a six-position two-conductor (6P2C), RJ14 uses a six-position four-conductor (6P4C) modular plug and jack, while RJ21 uses a 25-pair (50-pin) miniature ribbon connector. In another example, RJ45 connections can use an eight-contact 8P8C plug, and may also be referred to as T568A/T568B or Ethernet (for computers).

The RJ plugs include a flexible tab used to release the tab from the corresponding socket. A difficulty with RJ plugs is that the tab is weak and can break off due to wear, use, snagging, etc.

Some conventional solutions include a sleeve which covers the tab in order to make it less prone to catching or snagging onto other items or hazards, to prevent breaking off of the tab. Some other solutions have a mechanism which covers over the existing tab. Yet some other solutions try to exactly match the existing dimensions and form of the tab so that, once the tab breaks, the replacement solution can be used as a direct replacement.

A difficulty with existing solutions is that they may not be adaptable to be used for both of replacement and reinforcement, and sometimes does neither very well. As well, covering over the male RJ plug can increase bulkiness. These and other difficulties may be appreciated in view of the detailed description of example embodiments, below.

SUMMARY

At least some example embodiments relate to a clip and latch substitution device for a modular male RJ plug connector, with or without a broken clip or latch. The clip and latch substitution includes a securing base attached to a modular male RJ plug connector. The securing base has a top wall with two side walls with inside bottom clips to secure the device onto a modular male RJ plug. The main clip begins at the back of the securing base with a curved surface extending upwards from the base towards the front of the clip attaching to the latch.

At least some example embodiments relate to a replacement clip and latch for use on a male RJ Plug with a broken clip and latch. The replacement clip and latch includes has a securing base section configured to attach to the rear body of the male RJ plug. The securing base section consists of a top wall piece, two side walls with inside clips that secure under the body of the male RJ plug. The replacement clip and latch section begin with the clip extending from the back of the securing base and extending up and forward towards the front of the male RJ Plug, ending with the clip attaching to a latch which angles downwards to lodge between the broken clip section and the surface of the male RJ plug.

In accordance with an example embodiment, there is provided a clip and latch device including: a mount including a securing base defining a plane, a rear end and a front end; a resilient clip base mounted at the rear end of the securing base; a clip having a normally downward angle from the clip base towards the front end of the securing base; and a latch which terminates at the clip and normally extending so that the latch reaches to at least the plane of the securing base. The modular male plug can be a male RJ plug, with or without a broken tab or latch.

In accordance with another example embodiment, there is provided a system including a cable having a modular male plug, and the clip and latch device.

In accordance with another example embodiment, there is provided a method for a modular male plug having at least an upper surface and a front portion of a male plug latch, including: providing a device including: a mount including a securing base defining a plane, a rear end and a front end, a resilient clip base mounted at the rear end of the securing base, a clip having a normally downward angle from the clip base towards the front end of the securing base, and a latch which terminates at the clip; mounting the mount onto the modular male plug; and nesting an end of the latch between the upper surface and the front portion of the male plug latch.

BRIEF DESCRIPTION OF THE FIGURES

Embodiments will now be described by way of example with reference to the accompanying drawings, in which like reference numerals are used to indicate similar features, and in which.

DETAILED DESCRIPTION OF EXAMPLE EMBODIMENTS

At least one example embodiment includes a device configured to enable a male RJ plug with a broken clip to latch into a female register jack. The male RJ plug could be a telephone, a fiber-optic, Ethernet, or any male RJ plug connector designed to latch into a female register jack. However, for illustration, the example embodiments are described in conjunction with a male RJ45 plug with a broken clip and latch, herein referred to as a male RJ plug, realizing that one of ordinary skill in the art will be able to see how the example embodiments could be used to enable all types of male RJ plugs to latch into a female register jack.

In another example embodiment or use case, a clip and latch device can be used to reinforce by placing under an existing non-broken male RJ plug.

Figure 8:
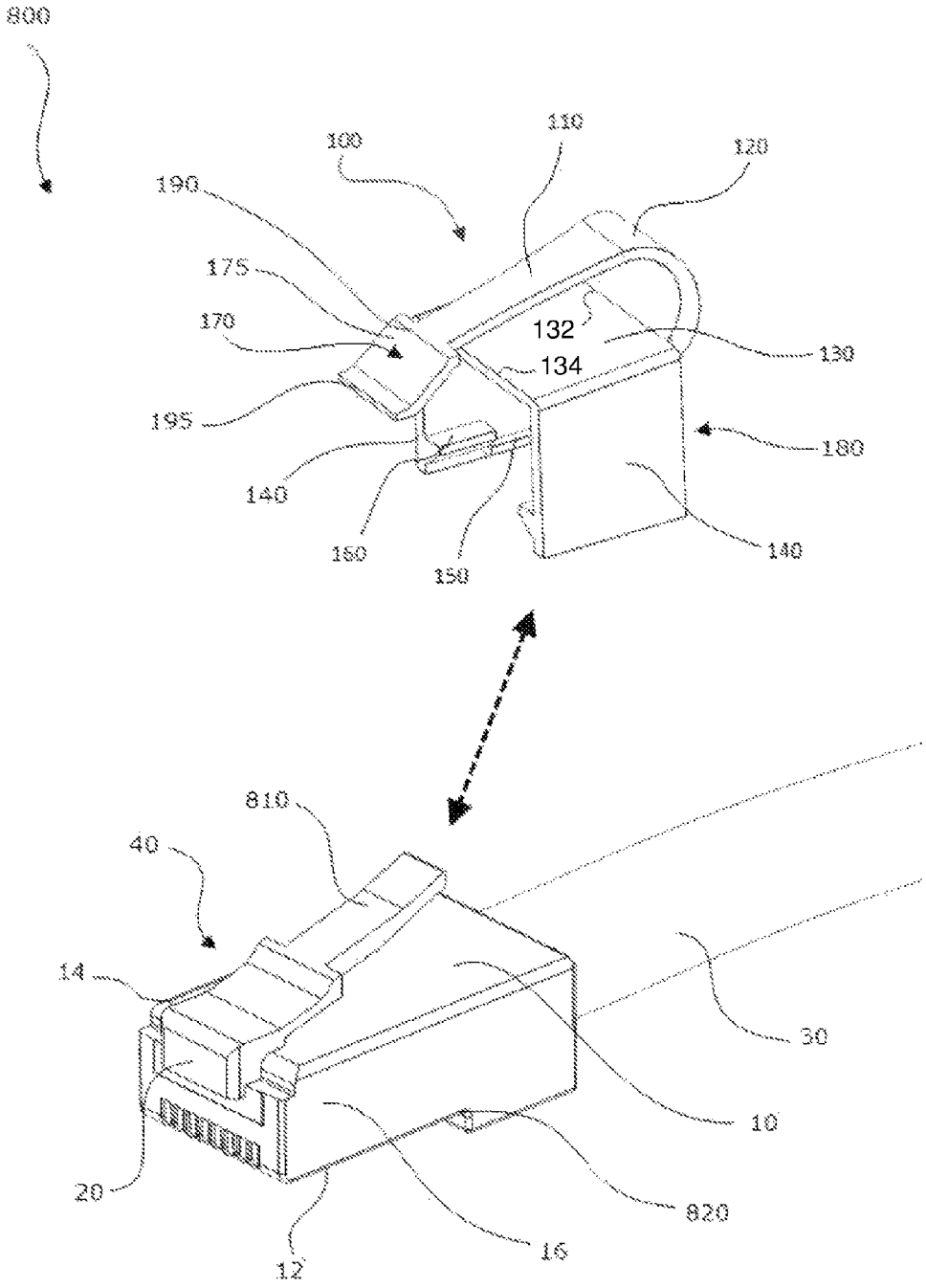
FIG. 8 illustrates an expanded perspective view of a system including a cable having a RJ plug and the example device shown in FIG. 1, in accordance with an example embodiment.

Reference is first made to FIG. 8, which illustrates a system 800 including a clip and latch device 100, in accordance with an example embodiment. The device 100 is for a cable 30 terminating to a connector such as a male RJ plug 40.

The cable 30 can be a conventional Ethernet cable, and includes an elongated base cable 30 and terminates to the male RJ plug 40 coupled to a distal end of the cable 30. In an example embodiment, the cable 30 may be, for example, a CAT5 cable as understood in the art, and the male RJ plug 40 may be, for example, a RJ-45 connector. However, some example embodiments are not limited to such cables and connectors and may be embodied to any cable/connector combination that is operable to couple to a socket, for example. The plug 40 includes a top surface 10, a bottom surface 12 located opposite the top surface 10, and the plurality of side surface 16, 18 extending between the top surface 10 and the bottom surface 12. A stop 20 extends from the bottom surface 12 of the plug 40 to prevent too much penetration. A male plug latch 810, or tab member, acts as a manual release member which is resiliently coupled to and extends from the top surface 10 of the plug 40. A plurality of electrical couplers (not shown) are located on the bottom surface 12 of the plug 40 and coupled to wiring (not shown) located in the cable 30.

In some example embodiments, referring still to FIG. 8, the male plug latch 810 is unbroken. Some users may wish to reinforce the existing male plug latch 810, to prevent the male plug latch 810 from breaking off.

Figure 2:
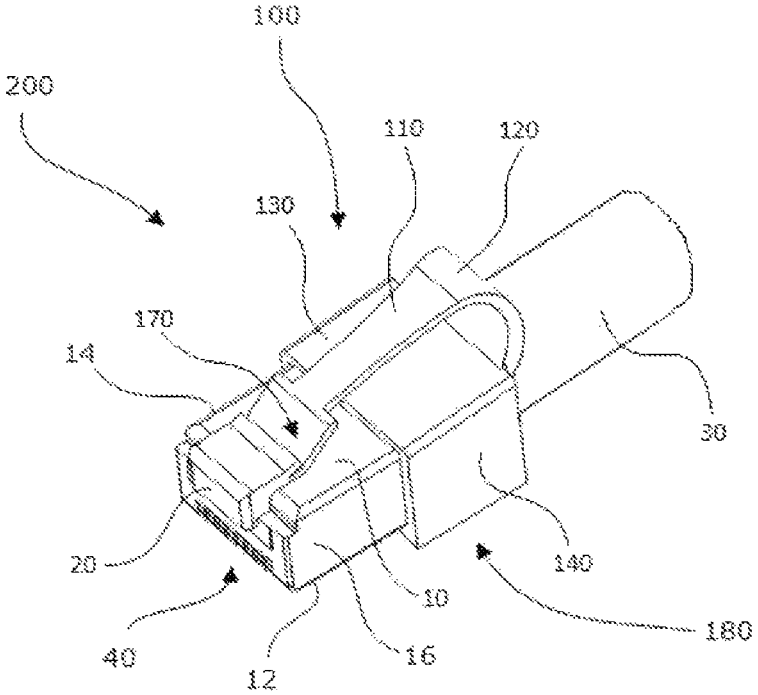
FIG. 2 illustrates a perspective view of a system including a RJ plug with a broken latch and the device shown in FIG. 1 mounted thereon, shown from the right side, front to back view, in accordance with an example embodiment.
Figure 3:
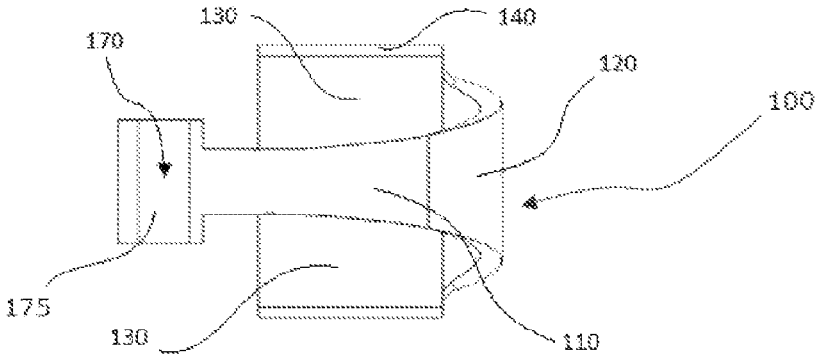
FIG. 3 illustrates a top view of the example device shown in FIG. 1, with the latch on the left.

Reference is now briefly made to FIG. 2, which shows another example system 200, in accordance with another example embodiment. The system 200 includes the device 100 used to replace a broken male plug latch 810 of the plug 40. When the male plug latch 810 (FIG. 8) is broken off, often only the front portion 20 remains, as illustrated in FIG. 2. Some users often may not wish to replace the entire cable 30, but rather use some of the existing elements of the plug 40 and cable 30. In the example embodiment shown in FIG. 2, the device 100 is used as a replacement to the broken male plug latch 810, and nests between the top surface 10 and the front portion 20.

Figure 1:
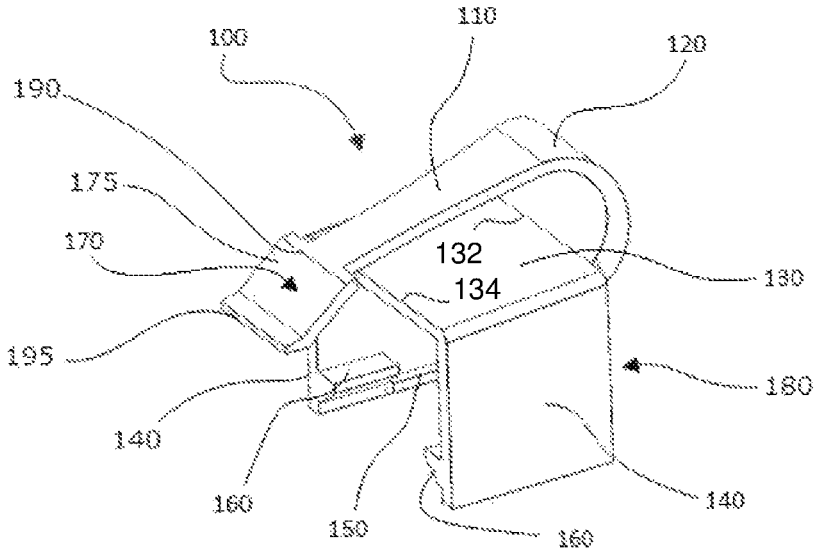
FIG. 1 illustrates a perspective view of an example clip and latch device from the right side, front to back view, in accordance with an example embodiment.

Reference is now made to FIGS. 1 to 7, which illustrate the clip and latch device 100 in greater detail, in accordance with an example embodiment. Referring now to FIG. 1 in particular, a mount 180 is used to mount the device 100 onto the plug 40, for example. The mount 180 includes a securing base 130 which defines at least a plane. The plane of the securing base 130 is typically parallel to the upper surface 10 of the plug 40 (FIG. 2), and the securing base 130 is typically configured to interface with the upper surface 10 of the plug 40. The securing base 130 also has a rear end 132 (or cable end 132) and a front end 134 (plug end).

A resilient clip base 120 is mounted at the rear end 132 of the securing base 130, and rises upwardly to a peak, at the rear end 132. As shown, the resilient clip base 120 can include a curved member having at least one curved surface.

A resilient clip 110 has one end connected to the clip base 120. The clip 110 has a normally downward angle from the peak of the clip base 120 towards the front end 130 of the securing base 130. Since the clip base 120 is resilient, "normally downward angle" means that in the resting or normal non-biased state the clip 110 is angled downwardly. The clip 110 may be moved away form this resting or normal state, for example during operation or upon connection to the plug 40.

Figure 4:
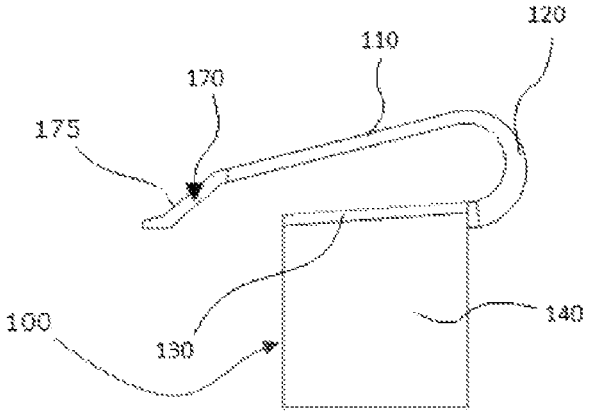
FIG. 4 illustrates a right side view of the example device shown in FIG. 1, the left side view being substantially identical.

A resilient latch 170 terminates at the other end of the clip 110. The end of the latch 170 can include a wedge 195, which can be considered part of the latch 170. The latch 170 is used to engage a corresponding female socket (not shown), such as an RJ plug female socket, which is the same type of female socket originally intended for the plug 40. The latch 170 includes at least one ridge 190 which latches into the female socket (not shown), and is releasable by way of manual operation. The length of the latch 170 and clip 110 are such that the end of the latch 170 (e.g. the wedge 195) normally extends so that the latch 170 reaches to at least the plane defined by the securing base 130, without actually connecting to the securing base 130. In an example embodiment, the latch 170 reaches exactly to this plane. In another example embodiment, as best illustrated in FIG. 4, the exterior upper surface 175 of the latch 170 can normally extend below (past) the plane defined by the securing base 130. As well, as shown in FIG. 4, the latch 170 normally extends to at least past the front end 134 of the securing base 130. Since the clip base 120 is resilient, "normally extends" means that in the resting or normal state the latch 170 clip 110 at least reaches the plane. In some example embodiments, in use, the latch 170 may naturally moved upwardly upon engagement with the upper surface 10 of the plug 40.

In an example embodiment, the ridge 190 of the latch 170 is formed by an exterior surface 175 of the latch 170 and an exterior surface of the clip 110. Specifically, the ridge 190 can snag into a corresponding female socket (not shown) when inserted.

After insertion of the jack 40 and the device 100 into the corresponding female socket (not shown), the ridge 190 catches into a corresponding part of the socket. Downward depression (e.g. manual) of the clip 110 or clip base 120 releases the latch 170 from the female socket (not shown).

In an example embodiment, the normally downward angle of the resilient clip 110 generally or exactly matches an angle, such as the normally upward angle, of the male plug latch 810 (FIG. 8) of the modular male plug 40. In an example embodiment, the exterior surface 175 is at an even greater or steeper angle than the normal angle of the clip 1010. As shown in FIG. 1, the wedge 195 may be at a flatter or more horizontal angle than the exterior surface 175 of the latch 170. In other example embodiments, not shown, the wedge 195 can have the same angle as the exterior surface 175 of the latch 170. In an example embodiment, the wedge 195 is any narrowing of the end of the latch 170.

Figure 5:
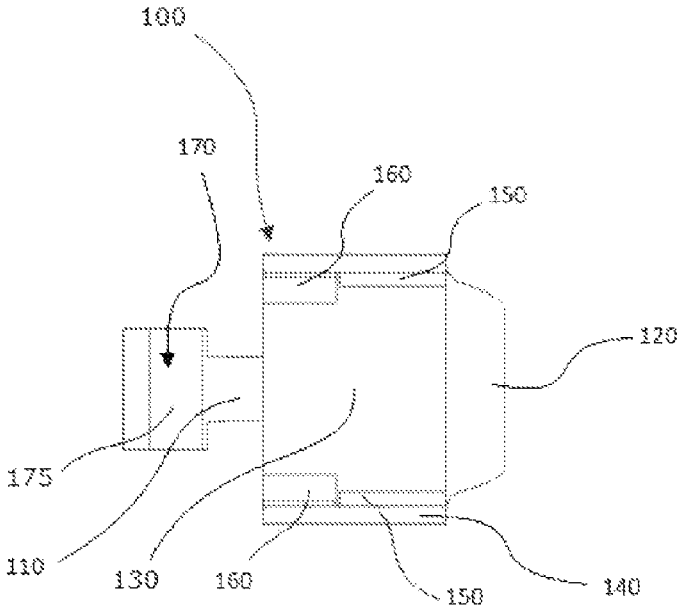
FIG. 5 illustrates a bottom view of the example device shown in FIG. 1, with the latch on the left.
Figure 6:
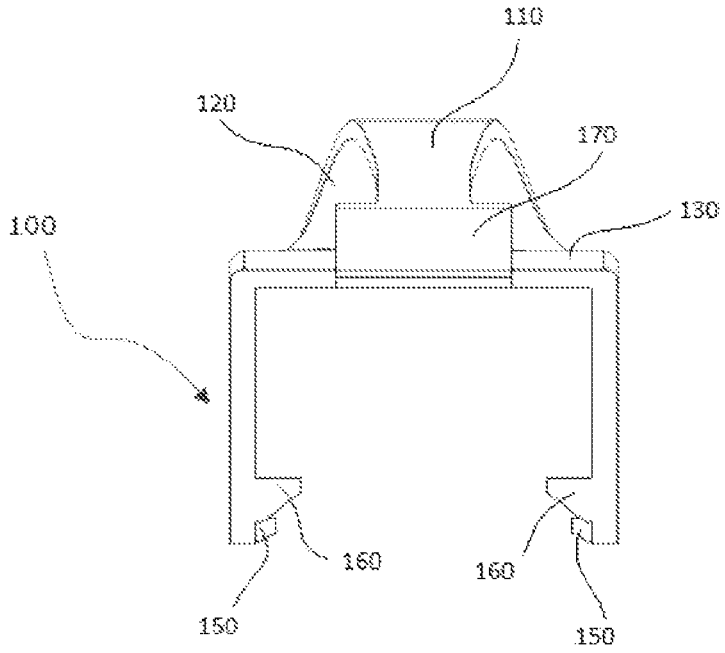
FIG. 6 illustrates a front view of the example device shown in FIG. 1, with a view of the latch.
Figure 7:
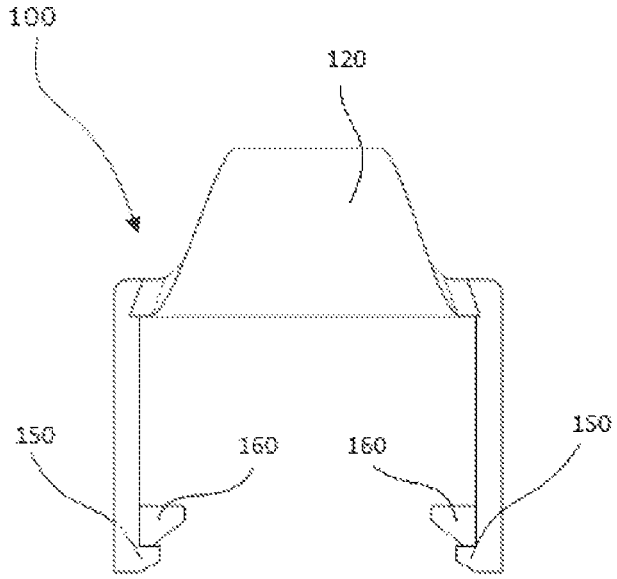
FIG. 7 illustrates a back view of the example device shown in FIG. 1, with a view of a base of the clip.

As shown best shown in FIGS. 1 and 5, the securing base 130 is attached to two side walls 140, which have four inside clips: two rear clips 150 and two front clips 160. In an example embodiment, only the two rear clips 150 or the two front clips 160, but not both, are provided.

As best illustrated in FIG. 8, one example function of the two inside front clips 160 is to hold down the securing base 130. Another example function is to prevent the securing base 130 from sliding backwards by stopping against the existing lower lip or stop 820 of the male RJ plug 40.

Referring again to FIG. 1 and the clip 110 in particular, one example function is to transfer force or tension from the clip base 120 to the top front edge of the latch 170. Another example function is to duplicate the original male RJ plug latch angle and orientation for the latch 170. Yet another example function of the clip 110 is to provide a way for the latch 170 to slide in and out of female register jack (not shown). This is accomplished by providing a flexible structure to move latch 170 up or down when it is being inserted or removed from a female register jack.

Referring still to FIG. 1 and the clip base 120 in particular, one example function of the clip base 120 is to transfer force or tension from the securing base 120 to the clip 110. Another example function of the clip base 120 is to position the clip 110 to an optimal height and angle for position with the latch 170.

Referring still to FIG. 1 and the mount 180 in particular, one example function of the securing base 130 is to provide a level support base for the clip base 120. This is accomplished with the help from the two side walls 140, with the primary front clips 160 and, in an example embodiment, the back clips 150. In an alternate example embodiment, the securing base 130 can be secured with double sided tape on the bottom side of the securing base 130, for example. Another example function of the securing base 130 is to flex while the two side walls 140 are being separated to attach the device 100 over a male RJ plug 40.

Referring still to FIG. 1 and the latch 170 in particular, one example function of the latch 170 is to secure the body of the male RJ plug 40 while inside a female register jack. This is accomplished with the latch 170 being wedged between the male RJ plug front portion 20 and surface 10, and latching to the top of a female register jack. Another example function of the latch 170 is help position the device 100 while on a male RJ plug 40.

In an example embodiment, the device 100 includes more than one latch 170, for example, more than ridge 190 on the surface 175 of the latch 170. This may allow the device 100 to be inserted into different female component sockets, which may have different or unknown depths due to different manufacturers, for example.

In an example embodiment, the device 100 is of unitary construction. In some example embodiments, suitable materials for the device 100 include plastic, metal, spring steel, and/or carbon fibre, for example.

As shown in FIG. 1, in an example embodiment, the device 100 is formed of panels or generally flat members. In other example embodiments, the elements of the device 100 can include thicker portions to increase durability, or thinner portions to increase elasticity, for example.

Reference is now made to FIG. 2, which illustrates a method for replacement of a broken male plug latch of a modular male plug 40, wherein only the front portion 20 remains. The method includes providing a device 100 having a mount 180 including a securing base 130 defining a plane, a rear end 132 and a front end 134, a resilient clip base 120 mounted at the rear end 132 of the securing base 130, a clip 110 having a normally downward angle from the peak of the clip base 120 towards the front end 134 of the securing base 130, and a latch 170 which terminates at the clip 110. The method includes mounting the mount 180 onto the modular male plug 40, and nesting an end or wedge 195 of the latch 170 between the upper surface 10 and the front portion 20 of the broken male plug latch.

Reference is now made to FIG. 8, which illustrates a method for reinforcement of an existing (non-broken) male plug latch 810 of a modular male plug 40. The method includes providing a device 100 having a mount 180 including a securing base 130 defining a plane, a rear end 132 and a front end 134, a resilient clip base 120 mounted at the rear end 132 of the securing base 130, a clip 110 having a normally downward angle from the peak of the clip base 120 towards the front end 134 of the securing base 130, and a latch 170 which terminates at the clip 110. The method includes mounting the mount 180 onto the modular male plug 40, and nesting an end or wedge 195 of the latch 170 between the upper surface 10, the front portion 20, and the male plug latch 810. The assembled version of the system 800 is illustrated in FIG. 9.

Figure 9:
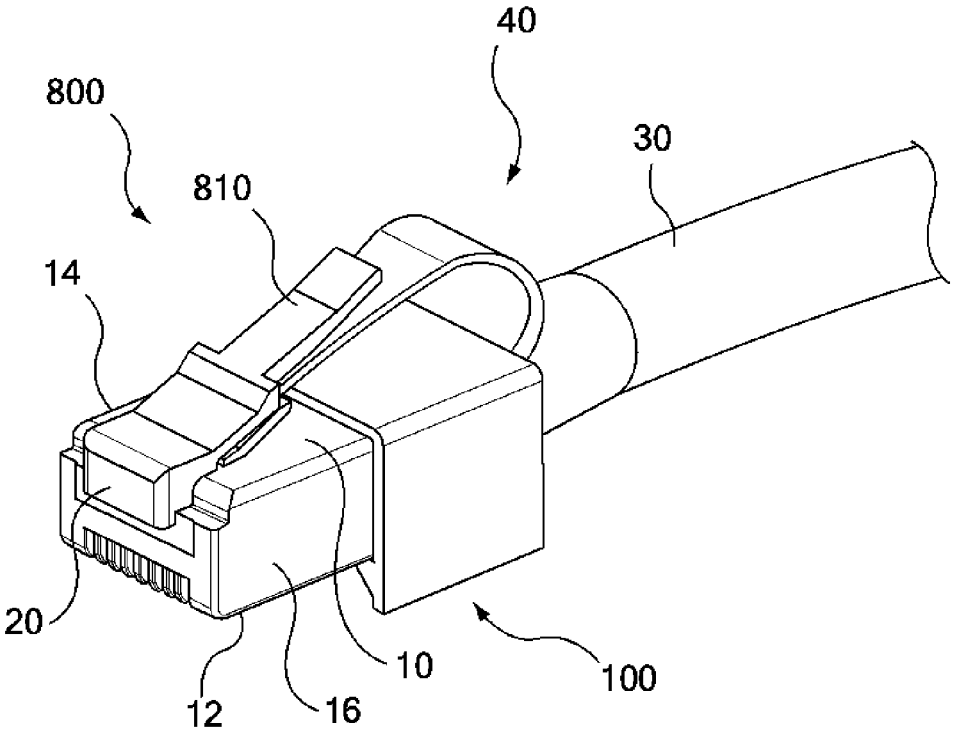
FIG. 9 illustrates a perspective view of the system shown in FIG. 8, with the device of FIG. 1 mounted to the RJ plug, shown from the right side, front to back view, in accordance with an example embodiment.

Referring still to FIGS. 8 and 9, after insertion of the jack 40 and the device 100 into the corresponding female socket (not shown), the existing male plug latch 810 of the plug 40 catches into a corresponding part of the socket. Downward depression (e.g. manual) of the male plug latch 810 releases the latch 170 from the female socket (not shown), and is reinforced by the clip 110 and clip base 120.

Accordingly, the device 100 can be used for both for reinforcement of the modular male plug 40 and for replacement of a broken male plug latch 810 of the modular male plug 40.

Figure 10:
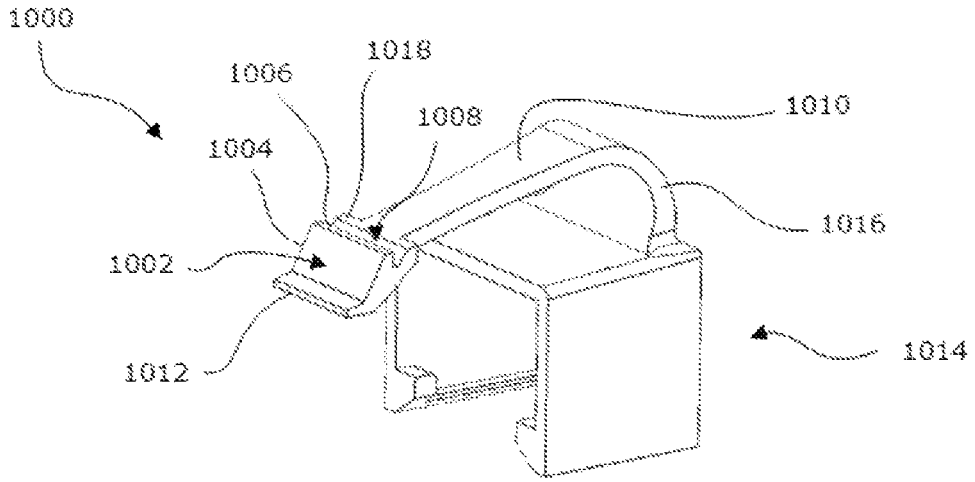
FIG. 10 illustrates a perspective view of an example clip and latch device from the right side, front to back view, in accordance with another example embodiment.

Reference is now made to FIGS. 10 to 17, which illustrate a clip and latch device 1000 in accordance with another example embodiment. Referring to FIG. 10 in particular, in an example embodiment, the device 1000 includes a resilient latch 1002 which is different when compared to the above-described latch 170 of the device 100 (FIG. 1). At least some or all of the remaining components can be substantially the same, in example embodiments.

As shown in FIG. 10, a mount 1014 is used to mount the device 1000 onto the plug 40, for example. A resilient clip base 1012 is mounted at the rear end of the mount 1014, and rises upwardly. As shown, the resilient clip base 1012 can include a curved member having at least one curved surface.

A resilient clip 1010 extends from the resilient clip base 1012 and has a normally downward angle. The latch 1002 terminates the end of the clip 1010.

The latch 1002 is used to engage a corresponding female socket (not shown), which is the same type of female socket (e.g. female RJ plug) originally intended for the particular type of plug 40 or RJ plug. A wedge 1012 can be at the end of the latch 1002.

In an example embodiment, the latch 1002 further comprises at least one ridge, shown as a first ridge 1006 and a second ridge 1018, which protrudes higher above the clip 1010 than the ridge 190 of the above-described device 100 (FIG. 1), for example. A groove 1008 defined between the ridges 1006, 1018 provides increased surface area for the ridge 1006 to latch onto a corresponding female socket (not shown). For example, some female sockets may be made from different manufacturers, and can be deeper or shallower than originally intended. The use of the additional ridges 1006, 1018 can be used to account for and latch onto varying depths. The groove 1008 can be dimensioned to be transverse across the latch 1002. Also as shown in FIG. 10, the ridge 1006 is formed between an exterior surface 1004 of the latch 1002 and the groove 1008. The ridge 1018 is formed between the groove 1008 and the clip 1010. In an example embodiment, the exterior surface 1004 is at an even greater or steeper angle than that of the clip 1010.

Figure 11:
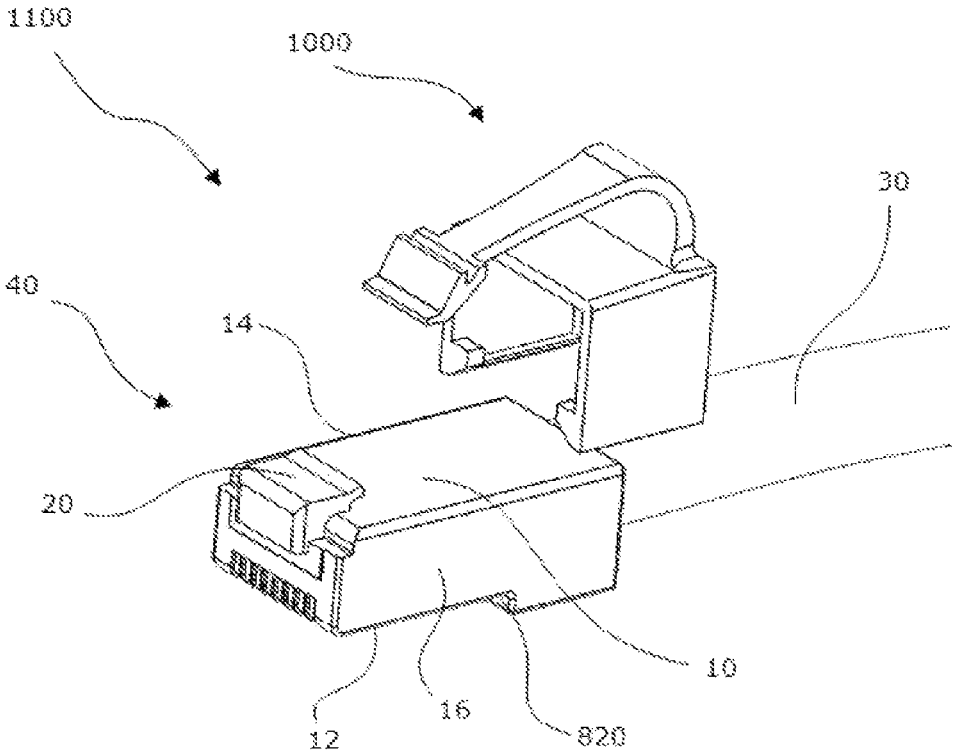
FIG. 11 illustrates an expanded perspective view of a system including a RJ plug with a broken latch and the device shown in FIG. 10 mounted thereon, shown from the right side, front to back view, in accordance with an example embodiment.
Figure 12:
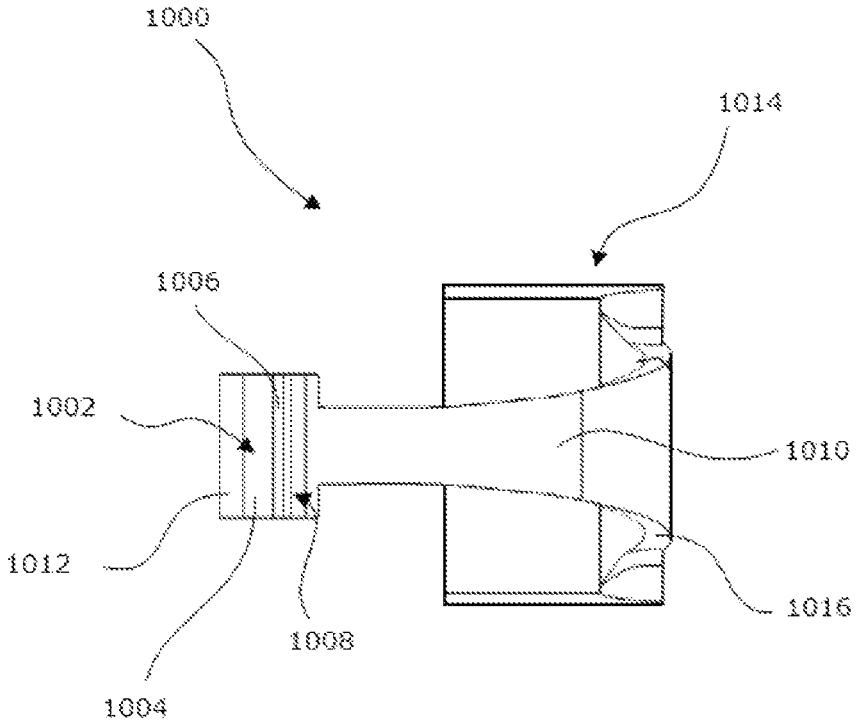
FIG. 12 illustrates a top view of the example device shown in FIG. 10, with the latch on the left.
Figure 13:
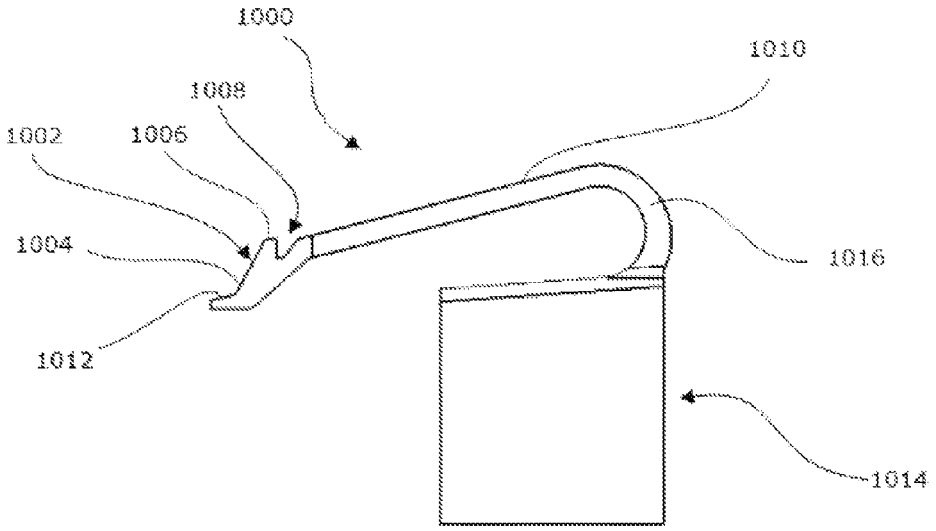
FIG. 13 illustrates a right side view of the example device shown in FIG. 10, the left side view being substantially identical.
Figure 14:
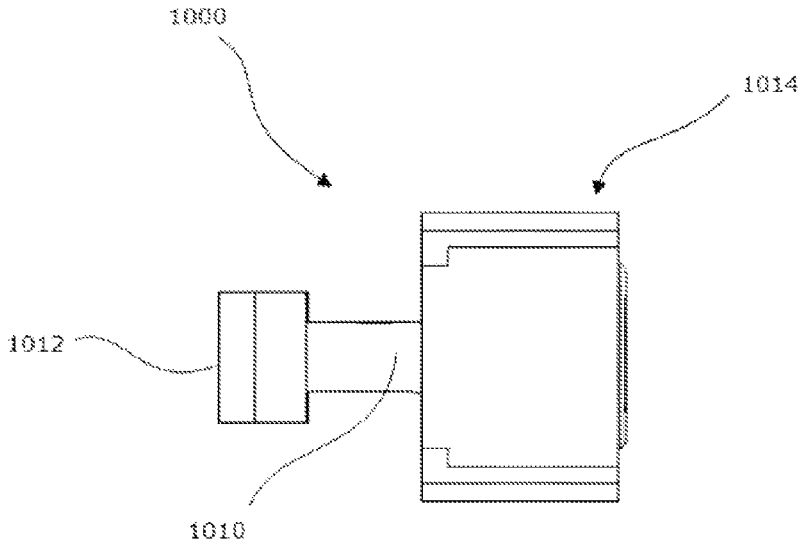
FIG. 14 illustrates a bottom view of the example device shown in FIG. 10, with the latch on the left.
Figure 15:
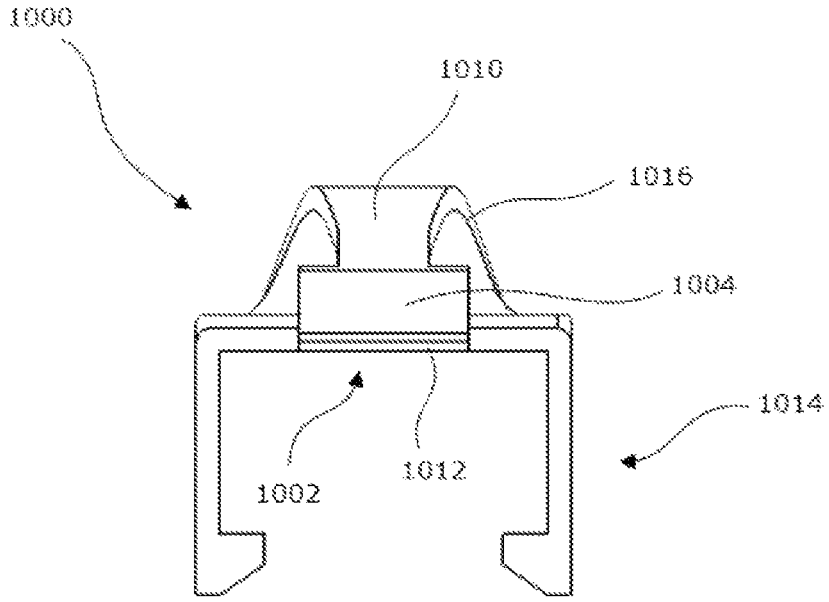
FIG. 15 illustrates a front view of the example device shown in FIG. 10, with a view of the latch.
Figure 16:
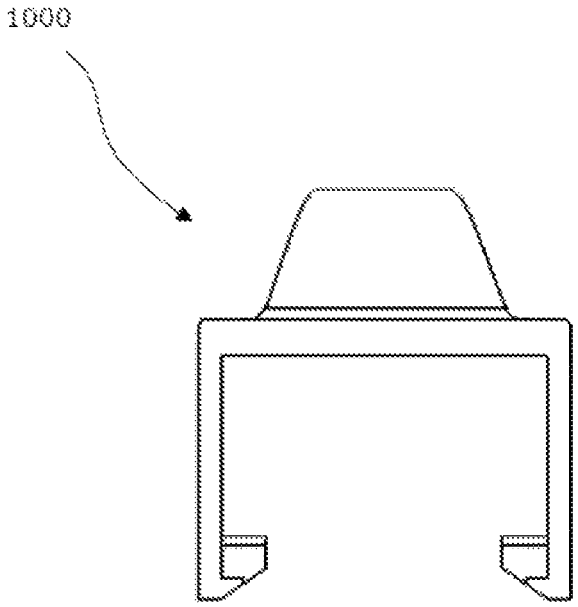
FIG. 16 illustrates a back view of the example device shown in FIG. 10, with a view of a base of the clip.

Reference is now briefly made to FIG. 11, which shows an example system 1100, in accordance with another example embodiment. The system 1100 includes the device 1000 used to replace a broken male plug latch 810 (FIG. 17) of the plug 40 where only the front portion 20 remains. In the example embodiment shown in FIG. 11, the device 1000 is used as a replacement to the broken male plug latch 810, and nests between the top surface 10 and the front portion 20 of the plug 40.

After insertion of the jack 40 and the device 1000 together into the corresponding female socket (not shown), the ridge 1006 and groove 1008 catch into a corresponding part of the female socket. Downward depression (e.g. manual) of the clip 1010 or clip base 1016 towards the mount 1014 releases the latch 1002 from the female socket (not shown).

Figure 17:
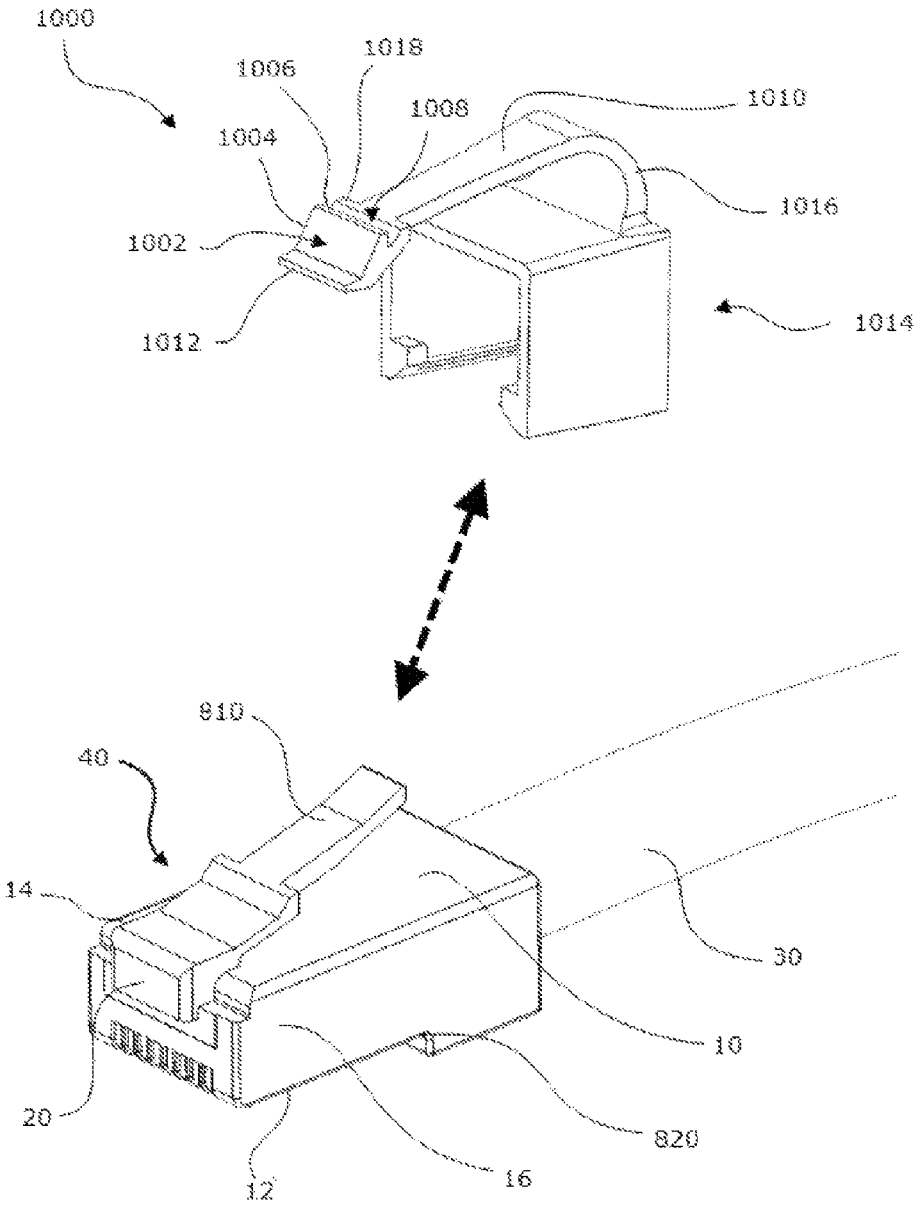
FIG. 17 illustrates an expanded perspective view of a system including a cable having a RJ plug and the example device shown in FIG. 1, in accordance with an example embodiment.

FIG. 17 illustrates a system 1800 for use of the device 1000 for reinforcement of an existing (non-broken) male plug latch 810 of a modular male plug 40. The device 1000 is mounted onto the modular male plug 40, and an end or wedge of the latch 1002 is nested between the upper surface 10, the front portion 20, and the male plug latch 810 of the modular male plug 40.

The jack 40 and the device 1000 together can be inserted into the corresponding female socket (not shown), wherein the ridge 1006 and groove 1008 catch into a corresponding part of the female socket. Downward depression (e.g. manual) of the male plug latch 810 releases the latch 810 from the female socket, and the latch 810 is reinforced by the clip 1010 and clip base 1016.

Reference to up, upward, down, downward, left, right, etc., are for convenience of reference to the particular concept or Figure being illustrated and not intended to be limiting to any particular orientation or operation.

Certain adaptations and modifications of the described embodiments can be made. Therefore, the above discussed embodiments are considered to be illustrative and not restrictive. Example embodiments described as methods would similarly apply to systems or devices, and vice-versa.

Variations may be made to some example embodiments, which may include combinations and sub-combinations of any of the above. The various embodiments presented above are merely examples and are in no way meant to limit the scope of this disclosure. Variations of the innovations described herein will be apparent to persons of ordinary skill in the art having the benefit of the present disclosure, such variations being within the intended scope of the present disclosure. In particular, features from one or more of the above-described embodiments may be selected to create alternative embodiments comprised of a sub-combination of features which may not be explicitly described above. In addition, features from one or more of the above-described embodiments may be selected and combined to create alternative embodiments comprised of a combination of features which may not be explicitly described above. Features suitable for such combinations and sub-combinations would be readily apparent to persons skilled in the art upon review of the present disclosure as a whole. The subject matter described herein intends to cover and embrace all suitable changes in technology.

What is claimed is:

1. A clip and latch device, comprising:

a mount including a securing base defining a plane, a rear end and a front end;

a clip base mounted at the rear end of the securing base;

a clip having a normally downward angle from the clip base towards the front end of the securing base; and a latch which terminates at the clip and normally extending so that the latch reaches to at least the plane of the securing base, wherein an exterior surface of the latch normally extends to at least past the plane of the securing base.

2. The clip and latch device as claimed in claim 1, wherein the latch further comprises a ridge connected at the clip.

3. The clip and latch device as claimed in claim 2, wherein the ridge is formed by an exterior surface of the latch and an exterior surface of the clip.

4. The clip and latch device as claimed in claim 2, wherein the latch further comprises a groove which increases a contact surface area of the ridge.

5. The clip and latch device as claimed in claim 1, wherein the latch includes an exterior surface normally having an angle steeper than the normally downward angle of the clip.

6. The clip and latch device as claimed in claim 1, wherein at least one or all of the clip base, the clip, and the latch are formed of resilient material.

7. The clip and latch device as claimed in claim 1, wherein the latch normally extends to at least past the front end of the securing base.

8. The clip and latch device as claimed in claim 1, wherein the normally downward angle of the clip generally matches an angle of a broken or unbroken male plug latch of a modular male plug.

9. The clip and latch device as claimed in claim 1, wherein the clip base includes a curved surface.

10. The clip and latch device as claimed in claim 1, wherein the latch further includes at least one further latch.

11. The clip and latch device as claimed in claim 1, further including a wedge which terminates at the latch.

12. The clip and latch device as claimed in claim 1, wherein the device is for reinforcement of a modular male plug, the modular male plug having a male plug latch and an upper surface, the device further comprising a wedge which terminates at the latch for nesting between the male plug latch and an upper surface.

13. The clip and latch device as claimed in claim 1, where the device is for replacement of a broken male plug latch of a modular male plug, the modular male plug having an upper surface and a front portion which remains from the broken male plug latch, the device further comprising a wedge which terminates at the latch for nesting between front portion and the upper surface.

14. The clip and latch device as claimed in claim 1, wherein the latch normally reaches to at least the plane of the securing base without connecting to the securing base.

15. The clip and latch device as claimed in claim 1, wherein the mount further comprises, below the plane, a first side wall having a first inward front clip and a second sidewall having a second inward front clip.

16. The clip and latch device as claimed in claim 15, wherein the first side wall further includes a first inward rear clip and the second sidewall further includes a second inward rear clip.

17. The clip and latch device as claimed in claim 1, wherein the device is of unitary construction.

18. A use of the clip and latch device as claimed in claim 1 for both reinforcement of a modular male plug having a male plug latch and for replacement of a broken male plug latch of the modular male plug.

19. A use of the clip and latch device as claimed in claim 1 for reinforcement of a modular male plug having a male plug latch.

20. A use of the clip and latch device as claimed in claim 1 for replacement of a broken male plug latch of the modular male plug.

21. A method for a modular male plug having at least an upper surface and a front portion of a male plug latch, comprising:

providing a device including: a mount including a securing base defining a plane, a rear end and a front end, a clip base mounted at the rear end of the securing base, a clip having a normally downward angle from the clip base towards the front end of the securing base, and a latch which terminates at the clip, wherein an exterior surface of the latch normally extends to at least past the plane of the securing base;

mounting the mount onto the modular male plug; and nesting an end of the latch between the upper surface and the front portion of the male plug latch.

22. The method as claimed in claim 21, wherein the method is both for reinforcement of the modular male plug and for replacement of a broken male plug latch of the modular male plug.

23. The method as claimed in claim 21, wherein the method is for reinforcement of the modular male plug, and the modular male plug includes the male plug latch being unbroken and connected to the front portion, wherein said nesting includes nesting the latch between the unbroken male plug latch and the upper surface.

24. The method as claimed in claim 21, wherein the method is for replacement of a broken male plug latch of the modular male plug, and the front portion remains from the broken male plug latch.

* * * * *